US005437133A

United States Patent [19]

Pliml

[11] Patent Number: 5,437,133

[45] Date of Patent: Aug. 1, 1995

[54] GRILLE FASTENER ASSEMBLY

[75] Inventor: Frank V. Pliml, Arlington Heights, Ill.

[73] Assignee: Illinois Tool Works, Inc., Glenview, Ill.

[21] Appl. No.: 984,960

[22] Filed: Dec. 3, 1992

[51] Int. Cl.[6] ..... E06B 3/70

[52] U.S. Cl. ..... 52/456; 49/57

[58] Field of Search ..... 292/163, DIG. 53; 52/456, 507, 311.3; 403/327; 411/393, 347, 348; 49/57

[56] References Cited

U.S. PATENT DOCUMENTS

| | | | |
|---|---|---|---|
| 607,260 | 7/1898 | Morse | 292/163 X |
| 884,481 | 4/1908 | Glaus | 292/163 |
| 2,681,481 | 6/1954 | Mason . | |
| 3,221,462 | 12/1965 | Pomeroy | 52/456 X |
| 3,340,661 | 9/1967 | Krieger | 52/456 |
| 3,358,412 | 12/1967 | Martin | 52/456 |
| 3,404,499 | 10/1968 | Lewis . | |
| 3,792,887 | 2/1974 | Ramsey | 403/327 X |
| 3,825,289 | 7/1974 | Armstrong | 292/163 |
| 3,918,202 | 11/1975 | Smith | 49/57 X |
| 4,474,393 | 10/1984 | Kimura | 292/DIG. 53 X |
| 4,838,001 | 6/1989 | Battles . | |
| 5,109,647 | 5/1992 | LaSee | 52/773 |

FOREIGN PATENT DOCUMENTS

| | | | |
|---|---|---|---|
| 2264166 | 10/1975 | France . | |
| 1428577 | 12/1968 | Germany | 292/163 |

*Primary Examiner*—Rodney M. Lindsey
*Attorney, Agent, or Firm*—Schwartz & Weinrieb

[57] ABSTRACT

A grille fastener assembly for releasably securing a wooden grille to a window sash having a generally rectangular-shaped frame with a single pane structure fixed therein includes a spring-loaded plunger assembly. The spring-loaded plunger assembly consists of a base portion, a plunger member and a coil spring. The plunger member and the base portion are movably secured together so as to sandwich the coil spring therebetween. The spring-loaded plunger assembly is telescopingly received in longitudinally extending openings formed in the terminal end portions of the grille bars and includes an enlarged end which is biased outwardly thereof and into respective central openings formed in grille strikes for releasably securing the grille to the sash frame.

19 Claims, 2 Drawing Sheets

GRILLE FASTENER ASSEMBLY

BACKGROUND OF THE INVENTION

1. Field of the Invention

This invention relates generally to a window grid construction and more particularly, it relates to a grille fastener assembly for releasably securing a wooden grille to a window or door frame.

2. Description of the Prior Art

As is well-known in the construction industry, conventional windows and/or doors are used extensively which have a single pane of glass. However, from an aesthetic and practical point of view it is often desirable to make the single window pane structure have the effect of multiple glass panes. In order to accomplish this effect, lattice window grids or ornamental grilles formed of vertical and horizontal bars are typically installed adjacent the window panes with the ends of the bars being attached to the door frame or a window sash in a frame.

The prior art appears to be best exemplified in the following patents which were developed in a search directed to the subject matter of this application: U.S. Pat. Nos. 2,681,481; 3,404,499; 4,838,001; 5,109,647; and French Patent No. 2,264,166.

As evidenced from the search, there are known in the prior art several fastener devices which have been employed for attaching ornamental grilles to conventional window sashes. For example, in U.S. Pat. No. 2,681,481 to E. G. Mason issued on Jun. 22, 1954, there is disclosed a hinged mullion-frame for use with a window sash having a frame with a single pane fixed therein. A latching device 57 is provided in a hole drilled into the lower end of a vertical bar 43 forming a part of the mullion-frame 41. The latching device includes a detent roll point button 61 which is urged downwardly by a compression spring 63. The latching device also includes a detent plate 65 formed in a cross rail 31 of the window sash and having a slot 69 for receiving the spring-pressed detent button 61, thereby securing the frame in position.

In U.S. Pat. No. 3,404,499 to R. N. Lewis issued on Oct. 8, 1968, there is disclosed a window unit which includes a pane divider 63 for releasable attachment to a sash frame 61 so as to subdivide a pane 62 into a plurality of smaller panes. A plunger 70 is slidably received within a hole 71 formed in a terminal end portion 66 of one of the divider members 65. A compression spring 74 is interposed between the plunger shoulder 72 and the shoulder 73 within the hole 71. The plunger 70 cooperates with a groove 64 spaced from the sash frame 61 for retaining the pane divider 63 in place. A handle 76 is provided to permit a user to retract the plunger 70 out of engagement with the groove 64 so that the pane divider 63 may then be removed.

In U.S. Pat. No. 4,838,001 to L. Battles issued on Jun. 13, 1989, there is taught a window grid latch 20 for removably attaching a decorative window grid 50 to a window sash 61. The grid latch includes a tubular housing 21, a retractable pin 36 carried by the housing, and a handle 38 for moving the pin between extended and retracted positions. A helical wire spring 43 is used to urge the pin forward causing it to extend outwardly beyond the forward end 26 of the housing. The grid latch is received within an axial bore 51 of the window grid strips 50. With the pin 36 in the retracted position, the window grid 56 is mounted adjacent a pane of glass 63 carried by the window sash 61. The grid latch is then moved to its extended position so that the pin 36 protrudes into pin-receiving slot 64.

Further, in U.S. Pat. No. 5,109,647 to J. C. La See issued on May 5, 1992, there is disclosed a concealed grille clip for securing a conventional grille to a window or door frame. The grille includes a plurality of grille bars secured to each other in right angular relation. Each grille bar has a recess in each end thereof. A plurality of grille clips formed of spring metal are used to secure each grille to the window frame. Each of the plurality of grille clips includes a frame engaging leg and a coupling leg. The frame engaging leg of each clip is secured to the window frame. The coupling leg in one embodiment has an outwardly convex outer surface which engages an angular recess in the grille bar with a snap coupling spring effect. In another embodiment, the coupling leg includes a rolled portion which engages an arcuate recess in the grille bar with a spring coupling action.

Finally, in French Patent No. 2,264,166, there is taught a window frame 4 with a pair of glazing longerons 7 wherein one end of each grid or longeron receives a pin which is used to join that end to the window frame 4. The longerons are then pivoted so that a pin 13 and a spring 20 received in the corresponding end sockets 19 thereof are projected into respective aligned frame sockets 22, thereby fixing the longerons in place.

The present invention represents a significant improvement over the spring metal grille clip shown and described in the aforementioned '647 patent. It has been found that the metal grille clips in the '647 patent are difficult for the average consumer to install. Further, when the grille is removed so that the window pane can be cleaned, the grille clips are frequently misplaced or lost. In addition it has been experienced that during the installation of the spring metal grille clips between the window sash and the glass pane a stress crack condition on the glass will be created.

Accordingly, it would be desirable to provide a simple spring-loaded plunger assembly which permits an ordinary user to easily install and remove the ornamental grilles from a window sash. It would also be expedient that the plunger assembly, when installed, present a substantially concealed means of attachment.

OBJECTS OF THE INVENTION

Accordingly, it is a general object of the present invention to provide a grille fastener assembly for releasably securing a wooden grille to a window sash which is relatively simple and economical to manufacture and assemble, but yet overcomes the disadvantages of the prior art fastener devices.

It is an object of the present invention to provide a grille fastener assembly which permits an ordinary user to easily install and remove an ornamental grille from a window sash.

It is another object of the present invention to provide a grille fastener assembly, which when installed, presents a substantially concealed means of attachment.

It is still another object of the present invention to provide a grille fastener assembly which is formed of a base portion, a plunger member, and a coil spring, the plunger and the base portion being movably secured together sandwiching the coil spring therebetween.

SUMMARY OF THE INVENTION

In accordance with these aims and objectives, the present invention is concerned with the provision of a grille fastener assembly for releasably securing a wooden grille to a window sash having a generally rectangular-shaped frame with a single pane structure fixed therein. A wooden grille is formed of a plurality of grille bars which are interconnected to each other through a right angular relationship. Each of the plurality of grille bars has an inner surface engaging an innermost surface of the single pane structure for simulating division thereof into a plurality of smaller panes. Each of the plurality of grille bars has a terminal end portion which is contoured to mate with a chamfered surface extending substantially about the interior periphery of the sash frame. The terminal end portion has a longitudinally extending opening therein.

A plurality of grille strikes are formed in the sash frame and are aligned with the terminal end portions of the plurality of grille bars. A spring-loaded plunger assembly is telescopingly received in the longitudinal opening formed in each one of the terminal end portions of the plurality of grille bars and has enlarged ends biased outwardly thereof and into respective central openings formed in the grille strikes for releasably securing the grille to the sash frame. The spring-loaded plunger assembly includes a base portion, a plunger member and a coil spring. The plunger member and the base portion are movably secured together so as to sandwich the coil spring therebetween.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the several views, and wherein.

DESCRIPTION OF THE PREFERRED EMBODIMENT

Figure 1:
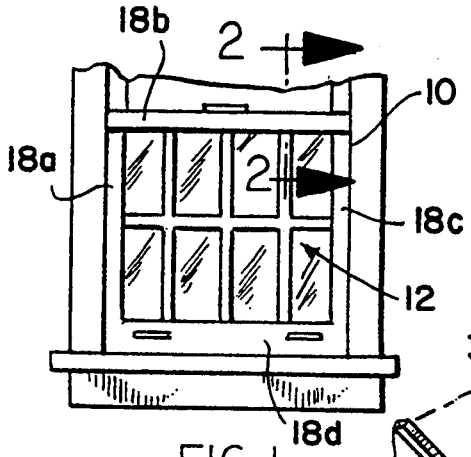
FIG. 1 is a front elevational view of a conventional window having a wooden grille secured thereto by a grille fastener assembly, constructed in accordance with the principles of the present invention.
Figure 1A:
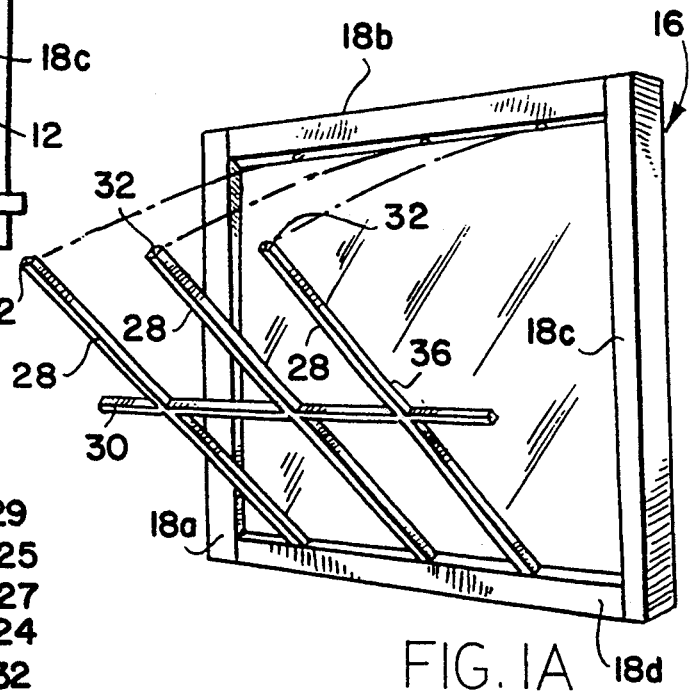
FIG. 1A is a perspective view similar to FIG. 1, but illustrating one step of the installation process.
Figure 2:
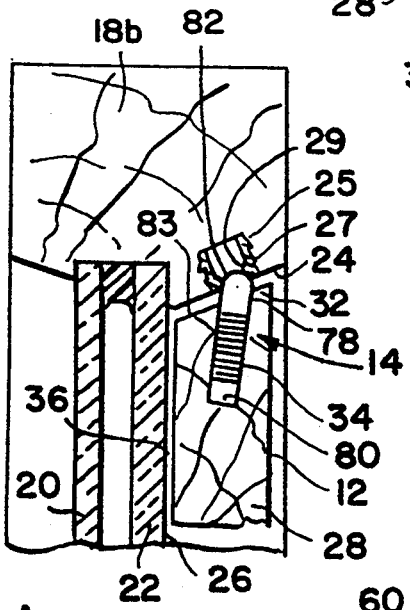
FIG. 2 is a cross-sectional view taken along the lines 2—2 of FIG. 1.

Referring now in detail to the various views of the drawings, there is shown in FIGS. 1, 1A and 2 a conventional window sash 10 having an ornamental wooden grille 12 secured thereto by a grille fastener assembly 14, constructed in accordance with the principles of the present invention. The window sash 10 includes a generally rectangularly-shaped sash frame 16 formed of sash frame members **18*a*–18*d* which are joined to each other in a right angular relationship. A single pane structure formed of transparent spaced apart window panes 20 and 22, such as glass, is mounted vertically and recessed within the window sash 10 in a conventional manner. It will be noted that each of the panes 20 and 22 is a solid single pane extending across the full expanse of the sash 10**.

In order to selectively simulate the effect of multiple window glass panes from the single pane structure, the wooden grille 12 is provided for releasable attachment to the sash frame 16. The sash frame is provided with a chamfered surface 24 spaced from the flat surface 26 of the innermost pane 22 and extends substantially about the interior periphery of the frame 16. The chamfered surface 24 is formed with a small hole 25 for receiving a grille strike 27. The chamfered surface 24 and the grill strike 27 are adapted to co-operate with means associated with the wooden grille 12 for releasably securing the grille to the sash frame, as will be explained more fully hereinafter. The grille strike is in the form of a plastic grommet with a punch-away center disc section 29 which is pre-installed in each one of the sash frame members **18*a*–18*d*. When the center disc section 29** is removed, there is created a hollow-type grommet.

The wooden grille 12 is comprised of a plurality of vertical bars 28 and a horizontal bar 30. The vertical bars 28 and the horizontal bar 30 are relatively arranged to form the grille according to the configuration of the number of multiple window panes desired to be simulated. These bars are tenoned at their points of intersection. As illustrated, three vertical bars 28 are joined to one horizontal bar 30 so as to form a grid pattern and simulates the division of the single pane structure into eight smaller rectangular panes. However, it should be readily apparent to those skilled in the art that any other number of divided pane arrangements could be simulated by providing a suitably patterned configuration of the vertical and horizontal bars. Each of the vertical and horizontal bars 28, 30 has a flat inner surface 36 which engages the flat surface 26 of the innermost pane 22. Further, each of the vertical and horizontal bars includes a terminal end portion 32 at each end thereof.

In order to releasably secure the grille 12 to the sash frame 16, the grille fastener assembly 14 of the present invention is inserted into each of the longitudinally extending openings 34 which are drilled into the terminal end portion 32 of each one of the vertical and horizontal bars for releasable engagement within each grille strike 27 disposed in the sash frame members **18*a*–18*d*. When so engaged, as shown in FIG. 2, the grille fastener assembly co-operates with the grille strike so as to hold the flat inner surface 36 of the vertical and horizontal bars tightly against the flat surface 26** of the innermost pane 22, thereby effecting the simulation of multiple glass panes.

Figure 3:
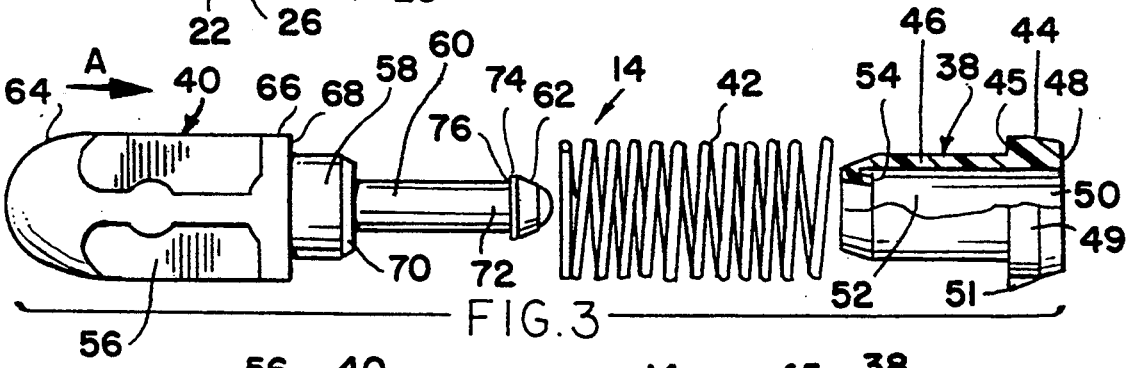
FIG. 3 is an exploded elevational view of the grille fastener assembly in accordance with the present invention.
Figure 4:
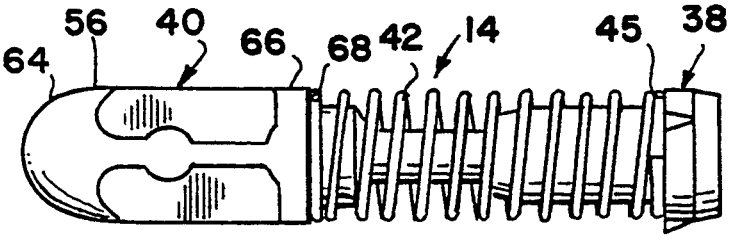
FIG.4 is a side elevational view of the grille fastener assembly of FIG. 3 with its component parts assembled together.
Figure 5:
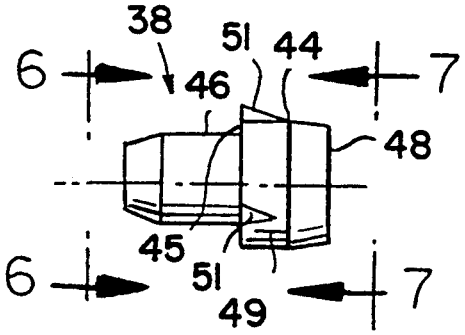
FIG. 5 is a side elevational view of the base portion of the grille fastener assembly.
Figure 6:
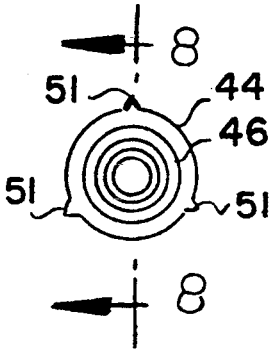
FIG. 6 is a left end view of the base portion of the grille fastener assembly as shown in FIG. 5.
Figure 7:
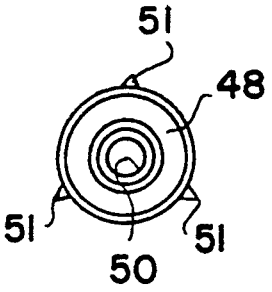
FIG. 7 is a right end view of the base portion of the grille fastener assembly as shown in FIG. 5.
Figure 8:
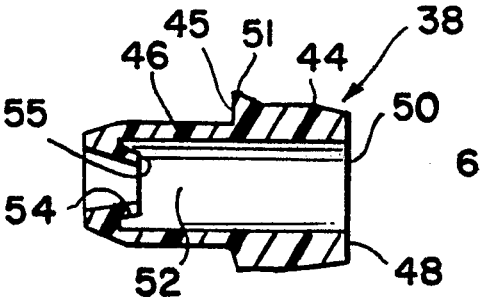
FIG. 8 is a cross-sectional view of the base portion of the grille fastener assembly, taken along the lines 8—8 of FIG. 6.
Figure 9:
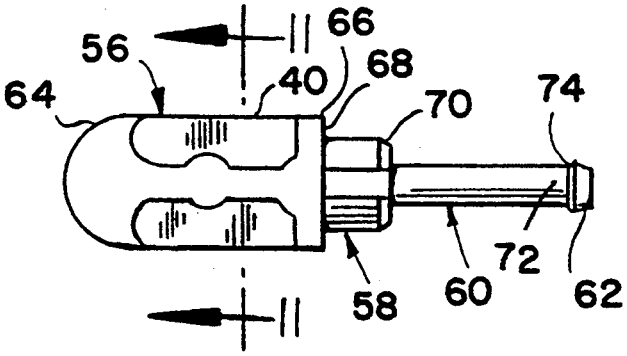
FIG. 9 is a side elevational view of the plunger member of the grille fastener assembly.
Figure 10:
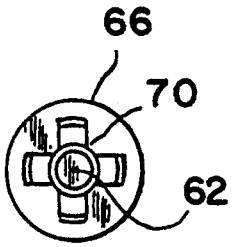
FIG. 10 is a right end view of the plunger member of the grille fastener assembly as shown in FIG. 9.
Figure 11:
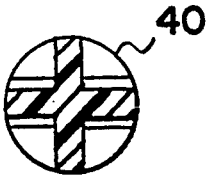
FIG. 11 is a cross-sectional view of the plunger member of the grille fastener assembly, taken along the lines 11—11 of FIG. 9.

As can best be seen from FIGS. 3 and 4, the grille fastener assembly 14 consists of a spring-loaded plunger assembly which is essentially comprised of a base portion 38, a plunger member 40, and a coil spring 42. The details of the base portion 38 are illustrated in FIGS. 5 through 8, and the details of the plunger member 40 are illustrated in FIGS. 9 through 11.

The base portion 38 includes a lower annular ring 44 and a tubular-shaped section 46 joined integrally with the annular ring at a radial shoulder 45. The annular ring has a flat bottom surface 48 which is adapted to abut an inner bottom surface of the longitudinally extending opening 34 formed in each one of the grille bars when assembled. The outer circumferential surface 49 of the annular ring 44 is provided with three equally spaced, small interference dimples or projections 51 which engage the inner wall surface of each opening 34 formed in the grille bars. The annular ring also has a central opening 50.

The tubular-shaped section 46 has a cylindrical bore 52 which is coaxially aligned for communication with the central opening 50. The tubular-shaped section further includes an inwardly sloping conical-like surface 54 which is disposed on the inner surface of the bore 52 adjacent its upper end. The sloping conical-like surface terminates in a continuous interior surface 55. Alternatively, locking tabs may be formed on the inner surface of the bore 52. The base portion is preferably made of a thermoplastic material such as nylon which can be manufactured easily and at reduced cost by a conventional injection molding process.

The plunger member 40 includes a cylindrical-shaped head portion 56, a cylindrical-shaped reduced shank portion 58, a stem or rod portion 60, and a disc-like end member 62. The head portion 56 has an enlarged end 64 which is substantially semi-spherical in shape and is adapted to engage with a central opening in the grille strike 27 when assembled. However, it should be apparent to those skilled in the art that the enlarged end 64 may be elliptical, oval or any other shape rather than the semi-spherical shape shown in the drawings.

The other end of the head portion 56 terminates in an annular flange 66 which is joined to one end of the shank portion 58 at a radial shoulder 68. The shank portion extends axially from the shoulder 68 to a lower end 70. One end of the rod portion 60 is joined to the lower end 70 and extends axially therefrom to the disc-like end member 62. The disc-like end member is formed integrally with the bottom end 72 of the rod portion and includes a mating flange 74 disposed adjacent the bottom end 72. The plunger member is also preferably made of a thermoplastic material such as nylon.

In order to form the plunger assembly, one end of the coil spring 42 is initially telescoped over the tubular-shaped section 46 of the base portion 38 and comes to rest against the lower radial shoulder 45. Then, the plunger member 40 is inserted into the other end of the coil spring until it engages with the upper radial shoulder 68 thereof. As the plunger member 40 is moved towards the base portion 38, the coil spring 42 will be compressed between the upper and lower radial shoulders 68,45.

The plunger member is pushed continually in the direction of the arrow A (FIG. 3) until the continuous interior surface 55 of the base portion 38 is snapped over and comes to rest upon the horizontal surface 76 of the mating flange 74 of the disc-like end member 62. As a result, the plunger member 40 and the base portion 38 are movably secured together sandwiching the coil spring 42 therebetween in a pre-loaded position with the desired tension for installation and retention, as illustrated in FIG. 4. Thus, it can be seen that this spring-loaded plunger assembly 14 can be shipped in bulk without danger of its components being tangled up.

As will be clearly seen from FIG. 2, the longitudinally extending opening 34 of a preselected depth is drilled in the terminal end portion 32 of each vertical bar 28 for receiving the plunger assembly 14. As previously pointed out, the projections 51 will engage with the inner surface 78 of the opening 34 so as to facilitate retention of the plunger assembly while the bottom surface 48 of the base portion 38 will come to rest on the bottom surface 80 of the opening. It will be noted that the center disc section 29 of the grille strike must be removed prior to use so as to create the central opening 82 therein. After the plunger assemblies 14 have been inserted into all of the terminal end portions of the remaining vertical and horizontal bars, the lower ends of the vertical bars 28 of the grille are attached to the lower sash frame member 18d so that the enlarged ends 64 of the head portions 56 of the plunger assemblies are received in the corresponding central openings 82 in the grill strike 27 disposed in the frame member 18d, as shown in FIG. 1A.

Next, the grille 12 is swung upwardly from the position in FIG. 1A to the installed or assembled position in FIG. 1. As can be seen in FIG. 2, the chamfered surface 83 on the grille bar and the chamfered surface 24 in the sash frame member 18b co-act closely with each other so as to cause the enlarged end 64 of the plunger member 40 to be pressed initially against the force of the coil spring 42. As the grille is moved continually inward, the coil spring will urge the enlarged end 64 into the central opening 82 in the grille strike, thereby releasably securing the grille to the window sash. It will be noted that the angle of engagement between the plunger member and the grille strike serves to maintain the inner surfaces 36 of the grille bars to be located tightly up against the innermost pane 22 of the window.

To remove the grille from the sash member, it is only necessary to preferably grasp the vertical bars 28 adjacent the upper terminal end portion 32 and pull them outward so as to retract the enlarged ends 64 of the corresponding plunger members out of engagement with the central openings 82 in the grille strikes 27. Then, the grille 12 may be pivotally moved away from the window pane 22 and removed thereafter for cleaning, painting and the like and then later installed when desired.

From the foregoing detailed description, it can thus be seen that the present invention provides a grille fastener assembly for releasably securing a wooden grille to a window sash having a generally rectangular-shaped frame with a single pane structure fixed therein. The grille fastener assembly is comprised of a base portion, a plunger member, and a coil spring. The plunger member and the base portion are movably secured together so as to sandwich the coil spring therebetween.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A grille fastener assembly for releasably securing a wooden grille to a window sash having a generally rectangular-shaped frame with a single pane structure fixed therein, comprising:

said wooden grille being formed of a plurality of grille bars interconnected to each other in a right angular relationship, each of said plurality of grille bars having a bottom surface engaging an innermost surface of said single pane structure for simulating division of said single pane structure into a plurality of smaller panes;

each one of said plurality of grille bars having a terminal end portion which is contoured so as to mate with a chamfered surface extending substantially about the interior periphery of said sash frame, said terminal end portion of each one of said grille bars having a longitudinally extending opening defined therein;

a plurality of grille strikes disposed within said sash frame and being aligned with said terminal end portions of said plurality of grille bars; and spring-loaded plunger assembly means telescopingly received within said longitudinally extending openings formed within said terminal end portions of said plurality of grille bars and having enlarged ends biased outwardly from said longitudinally extending openings and into respective central openings defined within said grille strikes for releasably securing said grille to said sash frame, wherein each one of said spring-loaded plunger assemblies, having an axial extent, comprises a base portion having a first, axially outer end portion and a second, axially inner end portion; a plunger member having a first axially outer end portion and a second axially inner end portion for engagement with said second axially inner end portion of said base portion whereby said base portion and said plunger member are secured together such that said base portion and said plunger member are axially movable with respect to each other; and a compression means interposed between said first axially outer end portions of said base portion and said plunger member for biasing said first axially outer end portions of said base portion and said plunger member away from each other.

2. A grille fastener assembly as claimed in claim 1, wherein said base portion includes an inwardly sloping conical-like surface terminating in a continuous interior surface disposed within a central bore thereof for interlocking engagement with a mating flange formed on said plunger member.

3. A grille fastener assembly as claimed in claim 2, wherein said base portion further includes projections formed on its outer circumferential surface for engagement, with the inner wall surface of the longitudinal opening formed in the terminal end portion, thereby facilitating retention of said plunger assembly in said grille bars.

4. A grille fastener assembly as claimed in claim 3, wherein said plunger member includes a head portion, a reduced shank portion, a rod portion and a disc-like end member, the enlarged ends of said plunger assembly means being formed in said head portion.

5. A grille fastener assembly as claimed in claim 4, wherein said enlarged ends of said head portion are substantially semi-spherical in shape.

6. A grille fastener assembly as claimed in claim 5, wherein said compression means comprises a coil spring.

7. A grille fastener assembly as claimed in claim 6, Wherein said base portion and said plunger member are formed of a thermoplastic material.

8. A grille fastener assembly as claimed in claim 7, wherein said base portion and said plunger member are formed of nylon.

9. A grille fastener assembly for releasably securing a grille to a window sash, comprising:

pane divider means extending across the interior of a sash frame and adjacent to a single pane structure for simulating division of said single pane structure into a plurality of smaller panes, said pane divider means having terminal end portions disposed adjacent to said sash frame;

grille strike means disposed within said sash frame and being aligned with said terminal end portions of said pane divider means; and spring-loaded plunger assembly means telescopingly received within longitudinally extending openings formed within said terminal end portions of said pane divider means and having enlarged ends biased outwardly from said longitudinally extending openings and into respective central openings formed within said grille strike means for releasably securing said pane divider means to said sash frame;

wherein each one of said spring-loaded plunger assemblies, having an axial extent, comprises a base portion having a first, axially outer end portion and a second, axially inner end portion; a plunger member having a first axially outer end portion and a second axially inner end portion for engagement with said second axially inner end portion of said base portion whereby said base portion and said plunger member are secured together such that said base portion and said plunger member are axially movable with respect to each other; and a compression means interposed between said first axially outer end portions of said base portion and said plunger member for biasing said first axially outer end portions of said base portion and said plunger member away from each other.

10. A grille fastener assembly as claimed in claim 9, wherein said base portion includes an inwardly sloping conical-like surface terminating in a continuous interior surface disposed within a central bore thereof for interlocking engagement with a mating flange formed on said plunger member.

11. A grille fastener assembly as claimed in claim 10, wherein said base portion further includes projections formed on its outer circumferential surface for engagement with the inner wall surfaces of the longitudinally extending openings formed in the terminal end portions of said pane divider means, thereby facilitating retention of said plunger assembly means in said pane divider means.

12. A grille fastener assembly as claimed in claim 11, wherein said plunger member includes a head portion, a reduced shank portion, a rod portion and a disc-like end member, the enlarged ends of said plunger assembly means being formed in said head portions.

13. A grille fastener assembly as claimed in claim 12, wherein said enlarged ends of said head portions are substantially semi-spherical in shape.

14. A grille fastener assembly as claimed in claim 13, wherein said compression means comprises a coil spring.

15. A grille fastener assembly as claimed in claim 14, wherein said base portion and said plunger member are formed of a thermoplastic material.

16. A grille fastener assembly as claimed in claim 15, wherein said base portion and said plunger member are formed of nylon.

17. A grille fastener assembly suitable for use in releasably securing a wooden grille to a window sash comprising:

a base portion, said base portion being formed of a lower annular ring and a tubular-shaped section joined to said annular ring at a first radial shoulder, said tubular-shaped section having a cylindrical bore which is coaxially aligned for communication with a central opening in said annular ring, said tubular-shaped section having an inwardly sloping conical-like surface terminating in a continuous interior surface and disposed interiorly of said bore;

a plunger member, said plunger member being formed of a head portion, a reduced shank portion, a rod portion and a disc-like end member, said head portion having an enlarged end adapted to engage a hole formed in the window sash, said head portion terminating in an annular flange which is joined to one end of said shank portion at a second radial shoulder, said shank portion extending away from said second shoulder to a lower end, one end of said rod portion being joined to said lower end of said shank portion, the other end of said rod portion being connected to said disc-like end member, said disc-like end member being formed with a mating flange;

a coil spring; and said continuous interior surface of said base portion being snapped over said mating flange of said plunger member so as to movably secure together said plunger member and said base portion and sandwiching the ends of said coil spring between said first and second radial shoulders.

18. A fastener assembly as set forth in claim 17, wherein:

said base portion and said plunger member are formed from a thermoplastic material.

19. A fastener assembly as set forth in claim 18, wherein:

said thermoplastic material comprises nylon.

* * * * *